US007760214B2

(12) United States Patent
Willis

(10) Patent No.: US 7,760,214 B2
(45) Date of Patent: Jul. 20, 2010

(54) INSERTING TRANSITIONS INTO A WAVEFORM THAT DRIVES A DISPLAY

(75) Inventor: Thomas E. Willis, Mountain View, CA (US)

(73) Assignee: Intel Corporation, Santa Clara, CA (US)

( * ) Notice: Subject to any disclaimer, the term of this patent is extended or adjusted under 35 U.S.C. 154(b) by 1008 days.

(21) Appl. No.: 10/919,989

(22) Filed: Aug. 17, 2004

(65) Prior Publication Data

US 2006/0038802 A1 Feb. 23, 2006

(51) Int. Cl.
*G09G 3/36* (2006.01)

(52) U.S. Cl. ..... 345/691; 345/89; 345/208

(58) Field of Classification Search ..... 345/691, 345/208, 89

See application file for complete search history.

(56) References Cited

U.S. PATENT DOCUMENTS

| | | | | |
|---|---|---|---|---|
| 5,977,940 | A * | 11/1999 | Akiyama et al. | 345/94 |
| 6,072,452 | A * | 6/2000 | Worleyl et al. | 345/89 |
| 6,285,346 | B1 * | 9/2001 | Melnik et al. | 345/87 |
| 2003/0007227 | A1 * | 1/2003 | Ogino | 359/227 |
| 2003/0201986 | A1 | 10/2003 | Willis et al. | 345/204 |
| 2004/0036707 | A1 | 2/2004 | Willis | 345/691 |
| 2004/0041825 | A1 | 3/2004 | Willis | 345/694 |
| 2004/0046752 | A1 | 3/2004 | Willis et al. | 345/204 |

FOREIGN PATENT DOCUMENTS

| | | | |
|---|---|---|---|
| EP | 0 224 388 | | 6/1987 |
| EP | 224388 | A2 * | 6/1987 |
| EP | 1 197 790 | | 4/2002 |
| WO | WO 03/073460 | A1 | 9/2003 |

OTHER PUBLICATIONS

European Patent Office, Communication Pursuant to Article 94(3) EPC dated Sep. 30, 2008.

The Patent Office of the State Intellectual Property Office of the People's Republic of China, Third Office Action dated August 14, 2009, in a related application.

* cited by examiner

*Primary Examiner*—Alexander Eisen
*Assistant Examiner*—Stuart McCommas
(74) *Attorney, Agent, or Firm*—Trop, Pruner & Hu, P.C.

(57) ABSTRACT

In one embodiment, the present invention includes a method of driving a first display element with a first pixel waveform that is a function of a desired color for the first display element and a second waveform; and inserting an added transition into the first pixel waveform to maintain a bias between the first pixel waveform and the second waveform.

22 Claims, 5 Drawing Sheets

INSERTING TRANSITIONS INTO A WAVEFORM THAT DRIVES A DISPLAY

BACKGROUND

The present invention relates generally to displays, and more particularly, using pulse-width modulation to drive one or more display elements of an electro-optical display.

Pulse-width modulation (PWM) has been employed to drive liquid crystal (LC) displays. A pulse-width modulation scheme may control displays, including emissive and non-emissive displays, which may generally comprise multiple display elements. In order to control such displays, the current, voltage or any other physical parameter driving the display element may be manipulated. When appropriately driven, these display elements, such as pixels, normally develop light that can be perceived by viewers.

In an emissive display example, to drive a display (e.g., a display matrix having a set of pixels), electrical current is typically passed through selected pixels by applying a voltage to the corresponding rows and columns from drivers coupled to each row and column in some display architectures. An external controller circuit typically provides the necessary input power and data signal. The data signal is generally supplied to the column lines and is synchronized to the scanning of the row lines. When a particular row is selected, the column lines determine which pixels are lit. An output in the form of an image is thus displayed on the display by successively scanning through all the rows in a frame.

For instance, a spatial light modulator (SLM) uses an electric field to modulate the orientation of an LC material. By the selective modulation of the LC material, an electronic display may be produced. The orientation of the LC material affects the intensity of light going through the LC material. Therefore, by sandwiching the LC material between an electrode and a transparent top plate, the optical properties of the LC material may be modulated. In operation, by changing the voltage applied across the electrode and the transparent top plate, the LC material may produce different levels of intensity on the optical output, altering an image produced on a screen.

Typically, a SLM, such as a liquid crystal on silicon (LCOS) SLM, is a display device where a LC material is driven by circuitry located at each pixel. For example, when the LC material is driven, an analog pixel might represent the color value of the pixel with a voltage that is stored on a capacitor under the pixel. This voltage can then directly drive the LC material to produce different levels of intensity on the optical output. Digital pixel architectures store the value under the pixel in a digital fashion, e.g., via a memory device. In this case, it is not possible to directly drive the LC material with the digital information, i.e., there needs to be some conversion to an analog form that the LC material can use.

In field sequential display devices, multiple colors are multiplexed across a display device to achieve a full-color display. A color management system (e.g., a color wheel or other such mechanism) then illuminates the display panel with light of the appropriate color. For example, each video frame may be divided into three sub-frames that display red data, green data, and blue data in sequence. During each sub-frame, the display panel modulates according to the value of the color component being displayed while the color management system illuminates the panel with the appropriate color.

An approach used in field sequential devices is known as "scrolling". In this approach, the data "scrolls" onto the display panel to improve efficiency. That is, rather than displaying all red data at the same time, the red data fills part of the display in time (as a result, the display panel will simultaneously display data from different color components), and so forth.

Scrolling systems can provide performance benefits in reduced display panel architectures. While analog modulation schemes are fairly easy to migrate to scrolling approaches, digital approaches face additional issues since they must properly transition state in the time domain. Thus scrolling presents certain challenges for digital modulation. A need thus exists to effectively implement digital modulation in scrolling and non-scrolling systems.

DETAILED DESCRIPTION

When modulating display elements forming a display, such as a display formed of individual pixels of a LC material, a per-pixel waveform (e.g., a PWM waveform) may drive one side of the LC material while an independent global waveform drives the other side. The per-pixel waveform may also be referred to herein as a pixel waveform or a PWM waveform. The global waveform may be fixed over the duration of a refresh time and may switch between two levels. The global waveform may also be referred to herein as an indium tin oxide (ITO) waveform, as it may be applied to an ITO electrode that may be located on a top plate of a display device. Further, while referred to herein as an ITO or global electrode, it is to be understood that the scope of the present invention is not so limited, as such terminology may refer to a single such global electrode, such as an ITO layer, or alternately a plurality of individual electrodes used to aid in activation of display elements corresponding to a single or multiple rows (or columns, depending on orientation), in certain embodiments.

Figure 1:
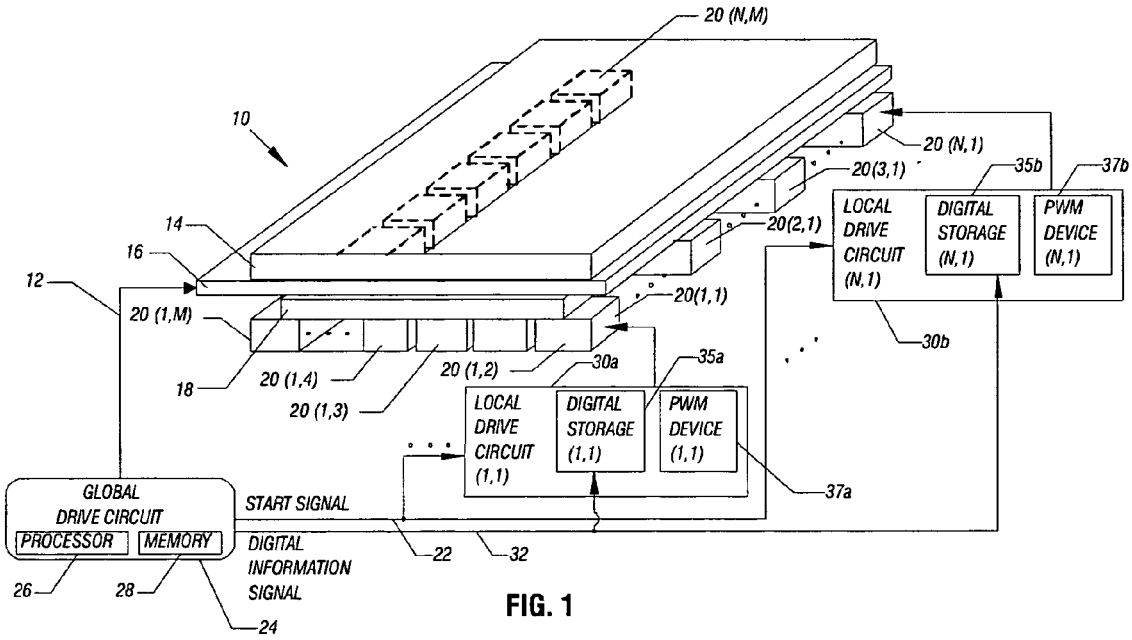
FIG. 1 is a block diagram of a display device in accordance with one embodiment of the present invention.

A display system 10 (e.g., a liquid crystal display (LCD), such as a spatial light modulator (SLM)) as shown in FIG. 1 includes a liquid crystal layer 18 according to an embodiment of the present invention. In one embodiment, the liquid crystal layer 18 may be sandwiched between a transparent top plate 16 and a plurality of pixel electrodes 20(1, 1) through 20(N, M), forming a pixel array comprising a plurality of display elements (e.g., pixels). In some embodiments, the top plate 16 may be made of a transparent conducting layer, such as indium tin oxide. Applying voltages across the liquid crystal layer 18 through the top plate 16 and the plurality of pixel electrodes 20(1, 1) through 20(N, M) enables driving of the liquid crystal layer 18 to produce different levels of intensity on the optical outputs at the plurality of display elements, i.e., pixels, allowing the display on the display system 10 to be altered. A glass layer 14 may be applied over the top plate 16. In one embodiment, the top plate 16 may be fabricated directly onto the glass layer 14.

A global drive circuit 24 may include a processor 26 to drive the display system 10 and a memory 28 storing digital information including global digital information indicative of a common reference and local digital information indicative of an optical output from at least one display element, i.e., pixel. In some embodiments, the global drive circuit 24 applies bias potentials 12 to the top plate 16. Additionally, the global drive circuit 24 may provide a start signal 22 and a digital information signal 32 to a plurality of local drive circuits (1, 1) 30*a* through (N, 1) 30*b*, each of which may be associated with a different display element being formed by the corresponding pixel electrode of the plurality of pixel electrodes 20(1, 1) through 20(N, 1), respectively.

In one embodiment, a LCOS technology may be used to form the display elements of the pixel array. Liquid crystal devices formed using the LCOS technology may form large screen projection displays or smaller displays (using direct viewing rather then projection technology). Typically, the LC material is suspended over a thin passivation layer. A glass plate with an ITO layer covers the liquid crystal, creating the liquid crystal unit sometimes called a cell. A silicon substrate may define a large number of pixels. Each pixel may include semiconductor transistor circuitry in one embodiment. However, in other embodiments other digital modulation schemes and devices, for example, a digital light processor (DLP), such as a microelectromechanical systems (MEMS) device (e.g., a digital micromirror device) may be used.

One technique in accordance with an embodiment of the present invention involves controllably driving the display system 10 using pulse-width modulation (PWM). More particularly, for driving the plurality of pixel electrodes 20(1, 1) through 20(N, M), each display element may be coupled to a different local drive circuit of the plurality of local drive circuits (1, 1) 30*a* through (N, 1) 30*b*, as an example. To hold and/or store any digital information intended for a particular display element, a plurality of digital storage (1, 1) 35*a* through (N, 1) 35*b* may be provided, each of which may be associated with a different local drive circuit of the plurality of local drive circuits (1, 1) 30*a* through (N, 1) 30*b*, for example. As discussed further below, such digital information may be used to determine at least one transition within a PWM waveform.

For generating a pulse-width modulated waveform based on the respective digital information, a plurality of PWM devices (1, 1) 37*a* through (N, 1) 37*b* may be provided in order to drive a corresponding display element. In one case, each PWM device of the plurality of PWM devices (1, 1) 37*a* through (N, 1) 37*b* may be associated with a different local drive circuit of the plurality of local drive circuits (1, 1) 30*a* through (N, 1) 30*b*.

Consistent with one embodiment of the present invention, the global drive circuit 24 may receive video data input and may scan the pixel array in a row-by-row manner to drive each pixel electrode of the plurality of pixel electrodes 20(1, 1) through 20(N, M). Of course, the display system 10 may comprise any desired arrangement of one or more display elements. Examples of the display elements include spatial light modulator devices, emissive display elements, non-emissive display elements and current and/or voltage driven display elements.

Figure 2:
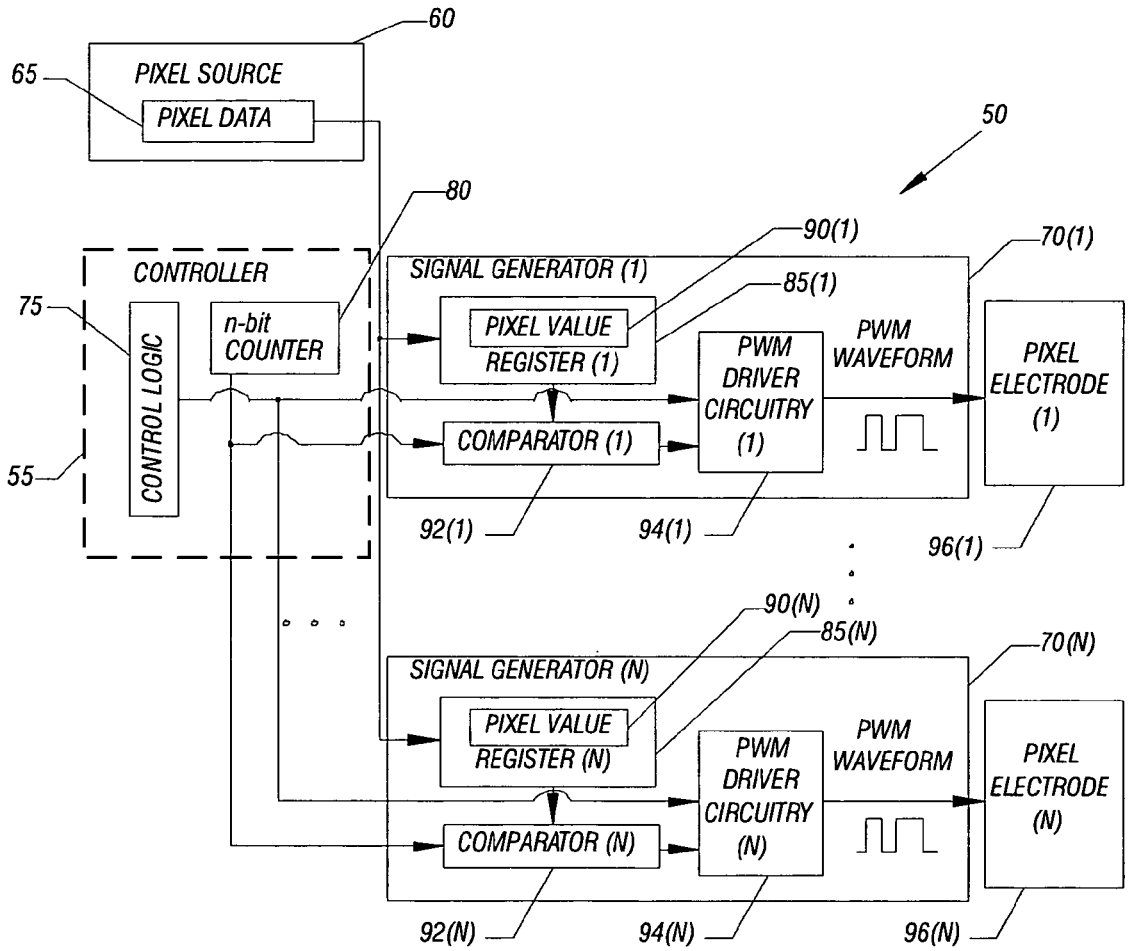
FIG. 2 is a block diagram of a display controller and display array in accordance with one embodiment of the present invention.

Following the general architecture of the display system 10 of FIG. 1, a SLM 50 shown in FIG. 2 includes a controller 55 to controllably operate SLM 50. For the purposes of storing digital information, SLM 50 may further include a pixel source 60. The pixel source 60 stores pixel data 65 comprising digital information that may include global digital information and local digital information in accordance with one embodiment of the present invention.

Although the scope of the present invention is not limited in this respect, pixel source 60 may be a computer system, graphics processor, digital versatile disk (DVD) player, and/or a high definition television (HDTV) tuner. In addition, pixel source 60 may not provide pixel data 65 for all of the pixels in the display system 10. For example, pixel source 60 may simply provide the pixels that have changed since the last update since in some embodiments having appropriate storage for all the pixel values, it will ideally know the last value provided by the pixel source 60.

SLM 50 may further comprise a plurality of signal generators 70(1) through 70(N), each associated with at least one display element. Each signal generator 70 may be operably coupled to controller 55 for receiving respective digital information. When appropriately initialized, each controller 55 and signal generator 70 may determine at least one transition in a PWM waveform based on the digital information to drive a different display element. It is to be understood that while the signal generators of FIG. 2 are shown with the specific components shown therein, the scope of the present invention is not so limited, and in other embodiments a signal generator may have different configurations.

As shown in FIG. 2, in one embodiment, controller 55 may incorporate a control logic 75 and a counter 80 (e.g., n-bit wide). The control logic 75 may controllably operate each display element based on respective digital information. To this end, counter 80 may provide global digital information indicative of a dynamically changing common reference, i.e., a count, to each display element.

Pulse-width modulation may be utilized for generating color in an SLM device in an embodiment of the present invention. This enables pixel architectures that use pulse-width modulation to produce color in SLM devices. In this approach, the LC material may be driven by a signal waveform whose "ON" time is a function of the desired color value.

Figure 3:
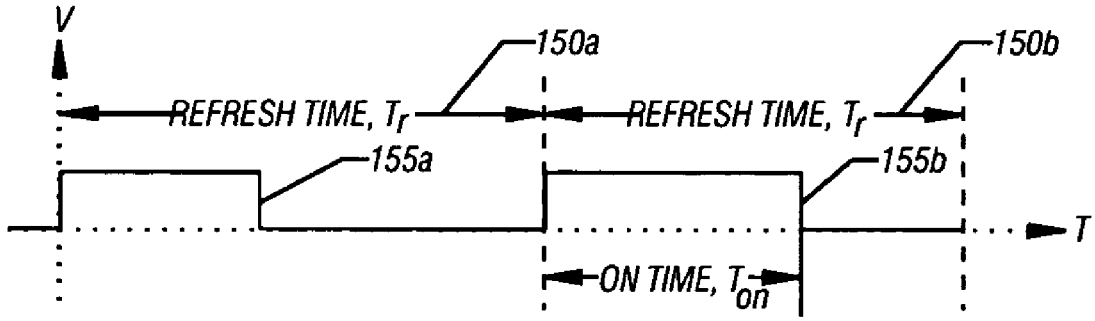
FIG. 3 is a hypothetical graph of applied voltage versus time for a spatial light modulator (SLM) in accordance with one embodiment of the present invention.

A hypothetical graph of an applied voltage versus time, i.e., a drive signal (e.g., a PWM waveform) is shown in FIG. 3 for a spatial light modulator in accordance with one embodiment of the present invention. Within a first refresh time period, $T_r$, 150*a*, the drive signal includes a first transition 155*a* and during the next cycle, i.e., within a second refresh time period, $T_r$, 150*b*, the drive signal includes a second transition 155*b*. The drive signal may be applied to pixel electrode 96(1) of FIG. 2, for example. Each transition of the first and second transitions 155*a*, 155*b*, separates the drive signal into a first and second pulse interval. The first pulse interval of the second refresh time period 150*b* is indicated as the "ON", time, $T_{on}$, as an example.

In some embodiments, the "ON" time, $T_{on}$, of the drive signal of FIG. 3 is a function, $f_{pwm}$, of the current pixel value, p, where $p \in [0, 2^n-1]$, n is the number of bits in a color component (typically 8 for some computer systems), $T_{on} \in [0, T_r]$, and $T_r$ is a constant refresh time. For example, if $f_{pwm}$, is linear, then $T_{on}$ may be given by the following equation:

$$T_{on} = f_{pwm}(p) = \frac{p}{2^n - 1} T_r \quad (1)$$

The first and second refresh time periods, i.e., $T_r$, 150*a* and 150*b*, may be determined depending upon the response time, i.e., $T_{resp}$, of the LC material along with an update rate, i.e., $T_{update}$, (e.g., the frame rate) of the content that the display system 10 (FIG. 1) may display when appropriately driven. Ideally, the refresh time periods, i.e., $T_r$, 150*a* and 150*b* may be devised to be shorter than that of the update rate, $T_{update}$, of the content, and the minimum "ON" time ($T_{on}$), may be devised to be larger than the response time, $T_{resp}$, of the LC material. However, $T_{on}$ may be time varying as a pixel value "p" may change over time.

Referring back to FIG. 2, in one embodiment, controller 55 may operate as follows. In step 1, control logic 75 may present a "start" signal (e.g., the start signal 22 of FIG. 1) to each PWM driver circuitry (N) 94, which may generate a corresponding PWM waveform for the attached pixel at each pixel electrode (N) 96. In step 2, each PWM driver circuitry (N) 94 in each pixel turns its output "ON" in response to the "start" signal.

The n-bit counter 80 (where "n" may be the number of bits in a color component) may begin counting up from zero at a frequency given by $2^n/T_r$ in step 3. In step 4, each pixel monitors the counter value using comparator circuit 92 (N) that compares two n-bit values, i.e., the counter and pixel values "c," "p" for equality. An n-bit register 85 (N) may hold the current pixel value for each pixel. When a pixel finds that the counter value "c" is equal to its pixel value "p," the PWM driver circuitry 94 (N) turns its output "OFF." This process repeats in an iterative manner by repetitively going back to the step 1 based on a particular implementation.

While the above process may be implemented in a display in accordance with an embodiment of the present invention, additional processing may occur in certain instances. For example, as will be discussed further below, if a refresh time of a global waveform terminates prior to a refresh time of a pixel waveform, an additional transition may be inserted into the pixel waveform. In such instances, control logic 75 may provide an inversion or similar signal to signal generator 70(N) to cause the additional transition. Such signal may be sent to driver circuitry 94(N), for example.

Figure 4:
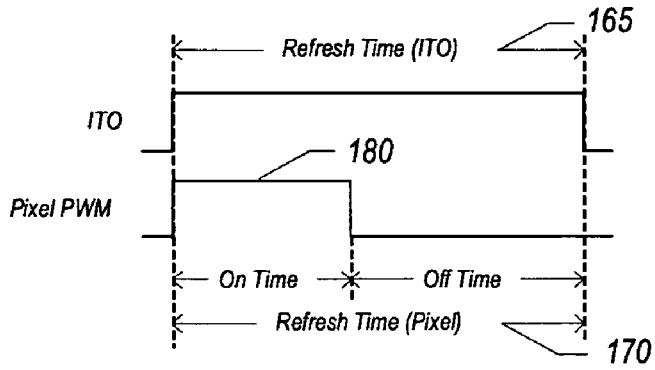
FIG. 4 is a graphical representation of hypothetical global and pixel waveforms in accordance with one embodiment of the present invention.

Referring now to FIG. 4, shown are hypothetical global and pixel waveforms in accordance with one embodiment of the present invention. As shown in FIG. 4, a global (i.e., ITO) waveform may have a refresh time 165, while a pixel waveform (i.e., Pixel PWM) may have a refresh time 170. As shown in FIG. 4, refresh time 165 and refresh time 170 may be equal. Further, the ITO waveform typically may be fixed over the duration of refresh time 165 and may switch between two levels (i.e., a logic low and a logic high). While shown in the embodiment of FIG. 4 as having a logic high value for refresh time 165, it is to be understood that in other embodiments, the ITO waveform may have a logic low or other logic level during the refresh time.

As further shown in FIG. 4, the pixel waveform includes a PWM pulse that has an on time 180 that corresponds to a desired length of time within refresh time 170 that the LC material is to be on. While shown in the embodiment of FIG. 4 as having a logic high value for on time 180, it is to be understood that in other embodiments a logic low or other logic level may be used to correspond to an on time. In practice, it is the bias between the ITO waveform and the pixel waveform that causes the LC material to be on for a given portion of a refresh time.

As shown in FIG. 4, in digital systems the ITO waveform may be constant over refresh time 165 so that the LC material may be modulated as desired. However, such a modulation scheme is not naturally compatible with the behavior of a scrolling system. Specifically, data that a given row of pixels in the device is presenting may skew across time. That is, if a first row starts its refresh time for a sub-frame f at a first time t, then a second row may effectively start its refresh time for sub-frame f at some later time t+Δ. As a result, in certain embodiments the time at which the global waveform changes state may be a function of a location of a display element. For example, the global waveform may change state based on a location of a row including a display element for a pixel waveform corresponding to the global waveform.

Figure 5:
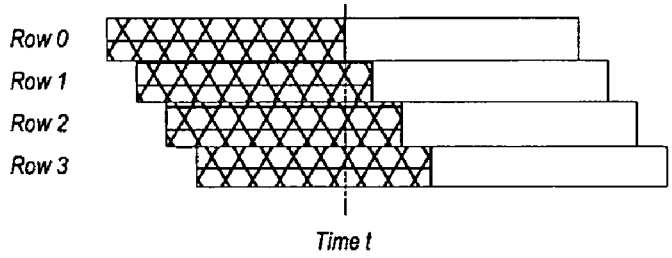
FIG. 5 is a graphical representation of two refresh periods for a plurality of rows of a display in accordance with an embodiment of the present invention.

Referring now to FIG. 5, shown is a graphical illustration of two refresh periods for a plurality of rows of a display in accordance with an embodiment of the present invention. As shown in FIG. 5, a plurality of rows (i.e., row 0 through row 3) is shown. These rows may correspond to four adjacent rows of a display. In FIG. 5, each row is shown to have two refresh times, one for each of two sub-frames (i.e., a first sub-frame f (shaded portion) and a second, later sub-frame f+1 (clear portion)).

Thus, as shown in FIG. 5, the shaded and clear portions represent the refresh time for given rows in sub-frames f and f+1, respectively. Note that due to scrolling, the refresh times skew across the display panel. As a result, there is no single "correct" point to transition the global waveform. For example, at time t in FIG. 5, the global waveform should transition for row 0 into the proper state for the clear portion, but the remaining rows are still performing modulation in the previous sub-frame, which requires that the global waveform remain in the state for the shaded portion.

In different embodiments, there may be different approaches to address this mismatch between the ITO state and the needs of the pixels. First, in some embodiments an ITO layer or electrode may be segmented so that groups of rows (or columns in left to right scrolling) have their own independent global electrode and corresponding global waveform. This global waveform may align with the pixel waveforms for the group. The number of rows that may have an independent global electrode and corresponding global waveform can vary in different embodiments. In such embodiments, the global waveform may be skewed or delayed to align with the corresponding pixel waveforms of the associated group.

In other embodiments, the pixel waveform may be modified to maintain the appropriate bias across the LC material. That is, in various displays, such as LC displays, the display material responds to the bias between the global and pixel waveforms. By injecting additional transitions into the pixel waveform, the bias between these waveforms may be maintained.

Figure 6:
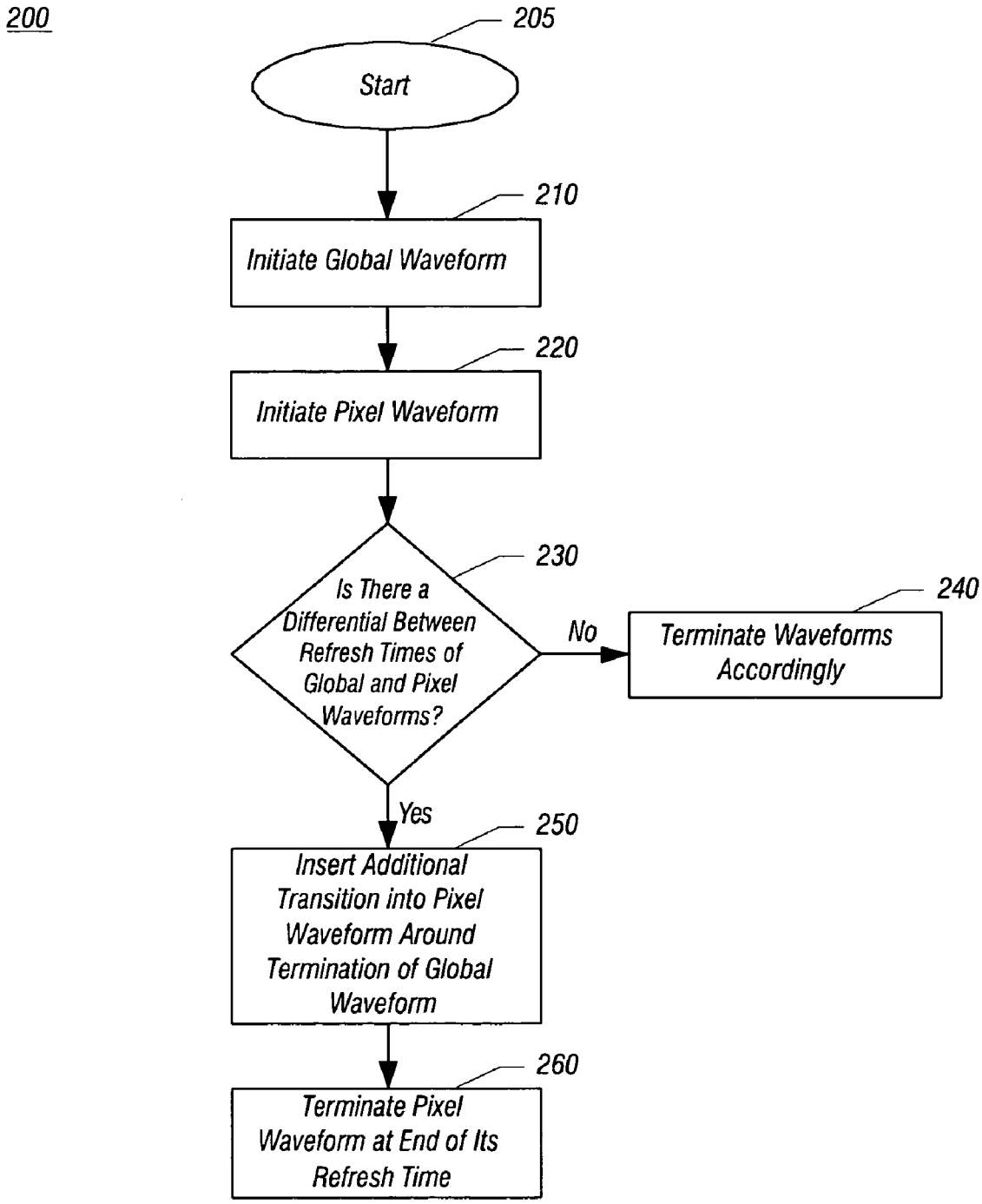
FIG. 6 is a flow diagram of a method in accordance with one embodiment of the present invention.

Referring now to FIG. 6, shown is a flow diagram of a method in accordance with one embodiment of the present invention. As shown in FIG. 6, method 200 may be used to insert additional transitions into a pixel waveform in accordance with an embodiment of the present invention. Method 200 may begin at a start location (oval 205). Such a start location may correspond to a beginning of a refresh time for a global waveform. As discussed above, such a waveform may be a single waveform to drive a global electrode of a display, or multiple waveforms may be present to independently drive a plurality of such global electrodes. The global waveform (or waveforms) may be initiated (block 210). Similarly, a pixel waveform may be initiated (block 220). Although discussed herein for a single pixel waveform, it is to be understood that at a substantially similar time a plurality of pixel waveforms may be initiated.

As discussed above, because of a delay that may occur in generating a pixel waveform, particularly in a scrolling system, the pixel waveform initiated in block 220 may not be coincident with initiation of the global waveform of block 210. Accordingly, it may be determined at diamond 230 whether a differential exists between the global waveform and the pixel waveform. More particularly, a differential between initiation of refresh times for the two waveforms may be determined. If no differential exists, both waveforms may continue in accordance with their normal driving, and may be terminated in a normal manner (block 240). For example, the global waveform may change its state at the end of its refresh period, while the pixel waveform may transition its state in accordance with its drive signals, for example, as dictated by a color to be displayed by the modulated pixel.

If instead at diamond 230 it is determined that a differential does exist between the waveforms (i.e., their refresh times), an additional transition may be inserted into the pixel waveform (block 250). More specifically, a transition may be added substantially around the time that the global waveform ends. For example, the transition may be inserted at the same time the refresh time of the global waveform ends, or in substantial proximity thereto.

In such manner, a bias between the global waveform and the pixel waveform may be maintained. Finally, the pixel waveform may be terminated in its then current state at the end of its refresh time (block 260). While FIG. 6 shows a method of inserting a transition into a single refresh period of a pixel waveform, it is to be understood that the method of FIG. 6 may be repeated continually for multiple refresh periods of the pixel waveform. Furthermore, while the method of FIG. 6 is shown for a single pixel waveform, it is to be understood that multiple pixel waveforms may implement the method.

Of course, in other embodiments different methods of maintaining a bias between the global waveform and a pixel waveform may be effected. For example, instead of determining a differential, an embodiment may simply insert a transition into a pixel waveform if it has not completed its refresh time when the corresponding global waveform refresh time has ended. For example, as discussed above with regard to FIG. 2, control logic 75 may send an inversion signal to driver circuitry 94(N) upon an end of a refresh time for a global waveform. The inversion signal may cause the additional transition in the corresponding PWM Waveform.

Figure 7:
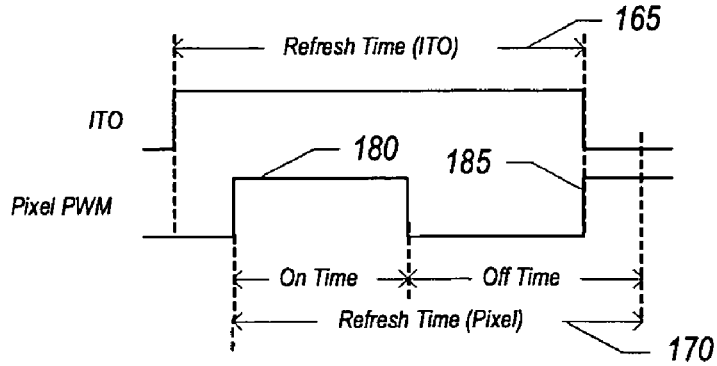
FIG. 7 is a graphical representation of refresh times for a pixel waveform and global waveform in accordance with one embodiment of the present invention that are not aligned.

Referring now to FIG. 7, shown is a graphical representation of a global waveform and a pixel waveform in accordance with an embodiment of the present invention. More specifically, as shown in FIG. 7, the pixel waveform may include an added transition 185 to maintain a bias between the pixel waveform and the corresponding global waveform.

Referring back to FIG. 4, refresh time 170 for the pixel waveform and refresh time 165 for the global waveform are aligned, such as may be present in a non-scrolling display. In this example, a zero bias is present for on time 180 of the pixel waveform and a non-zero bias is present for the off time. In contrast, FIG. 7 illustrates refresh times for the pixel waveform and global waveform that are not aligned, such as may be present in a scrolling device in accordance with an embodiment of the present invention. To maintain the bias between the waveforms, an additional transition may be introduced in the pixel waveform at the end of refresh time 165 for the global waveform (as shown at reference numeral 185 on the pixel waveform). This additional transition 185 may provide the same LC bias profile over pixel refresh time 170 as present in FIG. 4. Thus depending upon its state at the end of the global waveform refresh time, in some embodiments the pixel waveform may transition from a logic high state to a logic low state at the end of the global waveform refresh time 165.

As shown in FIG. 7, during on time 180, the LC bias is zero; during the first part of the off time (that is, until the end of refresh time 165), the LC bias is non-zero; during the last part of the off time (beyond the end of the global waveform refresh time 165, when additional transition 185 occurs), the bias is also non-zero. Because the LC material is insensitive to the polarity of the bias, only its presence, it is immaterial that the non-zero bias is sometimes "positive" and sometimes "negative".

In certain embodiments, the misalignment between refresh times for the global waveform and a pixel waveform, such as shown in FIG. 7 may be present in most rows of a scrolling system. As a result, scrolling may be achieved by setting the global waveform to track the pixel refresh time for a first row. Then in all other rows, additional PWM transitions may be introduced at the end of global refresh time 165 to maintain the desired bias between waveforms. For example, additional transition 185 (of FIG. 7) may occur at time t of FIG. 5 (i.e., the point at which the global waveform changes for row 0 but not for one of rows 1-3) for rows 1-3.

Many different hardware and software approaches may be used to inject the additional transition into the PWM waveform. For example, in an embodiment such as that shown in FIG. 2, control logic may be present to determine when a global waveform transitions to an off state at the end of its refresh time. With reference to FIG. 2, control logic 75 may control operation of the global waveform, and when an end of its refresh time occurs, control logic 75 may provide an inversion signal to cause an additional transition in corresponding pixel waveform(s) to maintain a desired bias between the global waveform and the pixel waveform(s).

In other embodiments, a toggle switch may be present and coupled to receive the global waveform. At the conclusion of a refresh time for the global waveform, the toggle switch may cause a transition to occur in corresponding pixel waveform(s). However, it is to be understood that the scope of the present invention is not so limited, and in other embodiments, different mechanisms (e.g., in hardware or software) may be used to insert such additional waveform transitions.

For example, embodiments may be implemented in a computer program that may be stored on a machine accessible storage medium having instructions to program a display system to perform the embodiments. The machine accessible storage medium may include, but is not limited to, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions. Other embodiments may be implemented as software modules executed by a programmable control device.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

driving a first display element with a first pixel waveform having a first transition from a first state to a second state during a refresh time for the first pixel waveform and a second waveform, the first pixel waveform a function of a desired color for the first display element;

determining if an initiation of a refresh time for the second waveform is coincident with an initiation of the refresh time for the first pixel waveform; and inserting an added transition from the first state to the second state into the first pixel waveform during the refresh time for the first pixel waveform to maintain a bias between the first pixel waveform and the second waveform if the initiations of the refresh times are not coincident.

2. The method of claim 1, wherein the first display element is off if the bias is present.

3. The method of claim 1, further comprising inserting the added transition substantially around an end of the refresh time for the second waveform.

4. The method of claim 1, wherein the first pixel waveform comprises a pulse-width modulated waveform.

5. A method comprising:

determining if an initiation of a first refresh period for a first global waveform is coincident with an initiation of a refresh period for a first plurality of pixel waveforms, and determining if an initiation of second refresh period for a second global waveform is coincident with an initiation of a refresh period for a second plurality of pixel waveforms;

maintaining a first constant bias between the first global waveform and the first plurality of pixel waveforms for driving a first plurality of rows of display elements of a display after an end of the first refresh period for the first global waveform; and maintaining a second constant bias between the second global waveform and the second plurality of pixel waveforms for driving a second plurality of rows of display elements of the display after an end of the second refresh period for the second global waveform.

6. The method of claim 5, wherein maintaining the first bias comprises inserting a second transition into the first plurality of pixel waveforms during the refresh period of the first plurality of pixel waveforms substantially around the end of the first refresh period for the first global waveform, wherein a first transition is inserted into the first plurality of pixel waveforms during the refresh period of the first plurality of pixel waveforms prior to the second transition, the first and second transitions from a first state to a second state.

7. The method of claim 5, wherein the first global waveform drives a first global electrode of the display and the second global waveform drives a second global electrode of the display.

8. The method of claim 7, further comprising driving a first display element of one of the first plurality of rows using the first global waveform and one of the first plurality of pixel waveforms and driving a second display element of one of the second plurality of rows using the second global waveform and one of the second plurality of pixel waveforms, wherein the one of the first pixel waveforms and the one of the second pixel waveforms have refresh periods with non-coincident initiations.

9. An apparatus comprising:

a signal generator to generate a drive signal for a display element, the signal generator to maintain a constant bias present between a global waveform and the drive signal at an end of a refresh period for the global waveform after the end of the refresh period for the global waveform, the global waveform having a constant fixed value for a duration of the refresh period;

logic to provide an inversion signal to the signal generator, the inversion signal to cause a state of the drive signal to change, wherein the logic is to determine if an initiation of the refresh period for the global waveform is coincident with an initiation of a refresh period for the drive signal; and the display element coupled to the signal generator to receive the drive signal.

10. The apparatus of claim 9, wherein the logic is to provide the inversion signal substantially around the end of the refresh period for the global waveform.

11. The apparatus of claim 9, further comprising a display controller housing the logic.

12. The apparatus of claim 9, wherein the apparatus comprises a color scrolled display.

13. A system comprising:

a spatial light modulator having at least one pixel to be driven by a pixel waveform and a global waveform;

a controller to provide a signal to cause a first transition in the pixel waveform from a first state to a second state during a refresh period of the pixel waveform, and an additional transition in the pixel waveform from the first state to the second state substantially around an end of a refresh period of the global waveform and during the refresh period of the pixel waveform if an initiation of the refresh period of the global waveform is determined to not be coincident with an initiation of the refresh period for the pixel waveform; and a signal generator to provide the pixel waveform to the at least one pixel.

14. The system of claim 13, wherein the additional transition is inserted to maintain a constant bias between the pixel waveform and the global waveform.

15. The system of claim 13, wherein the system comprises a color scrolled display.

16. The system of claim 13, wherein the system comprises a liquid crystal on silicon device.

17. A method comprising:

determining if an initiation of a refresh period for a global waveform is coincident with an initiation of a refresh period for a pixel waveform; and maintaining a constant bias present between the global waveform and the pixel waveform for driving a display element of a liquid crystal display at an end of the refresh period for the global waveform after the end of the refresh period for the global waveform, the global waveform having a constant fixed value for a duration of the refresh period.

18. The method of claim 17, wherein maintaining the constant bias comprises inserting a second transition into the pixel waveform during the refresh period of the pixel waveform substantially around the end of the refresh period, wherein a first transition is inserted into the pixel waveform during the refresh period of the pixel waveform and prior to the second transition, the first and second transitions from a first state to a second state.

19. The method of claim 17, further comprising inserting the transition if the initiations of the refresh periods are not coincident.

20. An article comprising a machine-accessible storage medium containing instructions that if executed enable a system to:

determine if an initiation of a refresh period for a global waveform is coincident with an initiation of a refresh period for a pixel waveform; and maintain a constant bias present between the global waveform and the pixel waveform at an end of the refresh period for the global waveform after the end of the refresh period for the global waveform, the global waveform having a constant fixed value for a duration of the refresh period.

21. The article of claim 20, further comprising instructions that if executed enable the system to insert a second transition into the pixel waveform during the refresh period of the pixel waveform substantially around the end of the refresh period for the global waveform, wherein the first transition is inserted into the pixel waveform during the refresh period of the pixel waveform and prior to the second transition, the first and second transitions from a first state to a second state.

22. The article of claim 20, further comprising instructions that if executed enable the system to provide an inversion signal to cause a state if the pixel waveform to change.

* * * * *